US007982605B2

(12) United States Patent
Freebody et al.

(10) Patent No.: US 7,982,605 B2
(45) Date of Patent: Jul. 19, 2011

(54) PUBLIC DISTRESS BEACON AND METHOD OF USE THEREOF

(76) Inventors: Allan P. Freebody, Pleasanton, CA (US); Kevin J. Freebody, Pleasanton, CA (US)

( * ) Notice: Subject to any disclaimer, the term of this patent is extended or adjusted under 35 U.S.C. 154(b) by 458 days.

(21) Appl. No.: 12/157,892

(22) Filed: Jun. 13, 2008

(65) Prior Publication Data

US 2009/0309723 A1 Dec. 17, 2009

(51) Int. Cl.
*G08B 13/08* (2006.01)

(52) U.S. Cl. ..... 340/545.1; 340/825.62; 340/539.14

(58) Field of Classification Search ..... 340/545.1, 340/539.1, 531, 533, 506, 539.16, 539.26, 340/5.2, 825.62, 825.69, 539.17, 539.14, 340/526

See application file for complete search history.

(56) References Cited

U.S. PATENT DOCUMENTS

| | | | | |
|---|---|---|---|---|
| 4,993,058 | A | 2/1991 | McMinn et al. | |
| 5,012,507 | A | 4/1991 | Leighton et al. | |
| 5,636,263 | A | 6/1997 | Thomson | |
| 5,646,912 | A | 7/1997 | Cousin | |
| 5,838,771 | A * | 11/1998 | Moeller | 379/37 |
| 5,991,363 | A * | 11/1999 | Thomson | 379/45 |
| 6,057,769 | A * | 5/2000 | Stevenson | 340/601 |
| 6,185,410 | B1 * | 2/2001 | Greene | 455/100 |
| 6,218,956 | B1 * | 4/2001 | Davis et al. | 340/5.2 |
| 6,471,373 | B1 | 10/2002 | Phillips | |
| 6,633,240 | B1 * | 10/2003 | Sweatt | 340/995.1 |
| 6,847,892 | B2 | 1/2005 | Zhou et al. | |
| 6,950,108 | B2 | 9/2005 | Doyle et al. | |
| 7,180,415 | B2 * | 2/2007 | Bankert et al. | 340/539.17 |
| 2006/0055543 | A1 * | 3/2006 | Ganesh et al. | 340/573.1 |

* cited by examiner

*Primary Examiner* — Daniel Previl

(74) *Attorney, Agent, or Firm* — Montgomery Patent and Design; Robert C Montgomery

(57) ABSTRACT

An automatic alerting apparatus and method, is herein disclosed, which audibly signals neighbors when a house or building door has not been opened in the previous twenty-four (24) hours. The system comprises a plurality of contacts aligned in a parallel connection on the exterior doors of a residence. The contacts are connected to a resettable twenty-four (24) hour timer. In use, if the timer is not rest in a twenty-four (24) hour period then power is supplied to an audible horn or beacon which alerts others to a potential emergency situation. It is envisioned that the device apparatus would have a back-up battery system for use during power failures and an override button for periods where no one will be in the residence for more than twenty-four (24) hours.

19 Claims, 3 Drawing Sheets

PUBLIC DISTRESS BEACON AND METHOD OF USE THEREOF

RELATED APPLICATIONS

The present invention was first described in a notarized Official Record of Invention on Aug. 27, 2007, that is on file at the offices of Montgomery Patent and Design, LLC, the entire disclosures of which are incorporated herein by reference.

FIELD OF THE INVENTION

The present invention relates generally to an automatic alerting system for incapacitated individuals and, more particularly, to an automatic alerting system which audibly signals neighbors when a house or building door has not been opened in the previous twenty-four (24) hours.

BACKGROUND OF THE INVENTION

As any home owner will attest, security is an area of primary concern. Due to the fact that people tend to place a high value on their property and personal safety, the marketplace has responded with a variety of products that are intended to protect one's life and property. A recent addition to these types of products are those that alert others to possible falls, dangers or medical conditions for those who live on their own and may be elderly or disabled. While these products work most of the time, they do require action on the part of the home dweller to activate in an emergency. This requirement is of an ironic nature since it is assumed that the person is incapable of helping themselves in the first place. Accordingly, there exists a need for a means by which elderly or disabled people living on their own can be provided with assistance during emergency situations without requiring action on their part. The development of the invention herein described fulfills this need.

The present invention is an automatic alerting system for incapacitated individuals which audibly signal neighbors when a house or building door has not been opened in the previous twenty-four (24) hours. The system utilizes a series of door contacts arranged in a parallel connection on all exterior doors of a home, apartment or similar structure. The door contacts then switch power to a resettable twenty-four (24) hour timer. Should the timer not be reset within a twenty-four (24) hour period, it will then apply power to an audible alerting device and a visual alerting device, both located on an exterior surface of a dwelling. The audible alerting device and the visual alerting device are intended to alert neighbors, passer-bys, motorists, delivery personnel, mail persons, and others who are in the vicinity of the dwelling that a possible emergency situation exists on the inside of the dwelling. The present invention is equipped with a battery backup for operation during a power failure, and a vacation interrupt switch which disables the system during planned sessions of absence. The use of the present invention provides a means for tracking activities of elderly or disabled people who live on their own in an automatic yet discrete manner which helps address possible medical emergencies.

Several attempts have been made in the past to provide alerting systems for incapacitated individuals. U.S. Pat. No. 4,993,058, issued in the name of McMinn et al., describes an illuminated house light display that provides a visual warning signal to guide summoned emergency personnel. Furthermore, U.S. Pat. No. 5,012,507, issued in the name of Leighton et al., is a telephone activated emergency light system. However, unlike the present invention, the McMinn and the Leighton systems are activated by dialing a numeric emergency sequence on a telephone.

U.S. Pat. Nos. 5,636,263 and 5,991,363, both issued in the name of Thomson, disclose a high-intensity light emitting diode that is activated by an emergency service dispatcher over a telephone line used by a person who telephones for emergency help. The Thomson apparatus assures that emergency personnel will quickly and easily find the emergency site when they arrive in the general location. However, unlike the present invention, the Thomson systems are activated over a telephone line.

U.S. Pat. No. 6,471,373, issued in the name of Phillips, discloses an emergency strobe light system that flashes to alert rescue personnel when a radio frequency signal is transmitted to a telephone interface. However, unlike the present invention, the Phillips system is activated when the dialing of an emergency number has been detected by one of the telephone interfaces.

U.S. Pat. No. 6,950,018, issued in the name of Merrell et al., discloses an alarm system comprising at least one wireless alarm transmitter, at least one wireless activate transmitter, and at least one wireless signal receiver. However, unlike the present invention, the Merrell system displays a text message alarm to alert hearing impaired people of hazardous conditions.

None of the prior art particularly describes an automatic alerting system for incapacitated individuals which audibly signals neighbors when a house or building door has not been opened in the previous twenty-four (24) hours and that does not require action on the individuals part that the instant invention possesses. Accordingly, there exists a need for an alerting system by which elderly or disable people living on their own can be provided with assistance during emergency situations without requiring action on their part that operates without the disadvantages as described above.

SUMMARY OF THE INVENTION

In view of the foregoing disadvantages inherent in the prior art, it has been observed that there is need for an automatic alerting system for incapacitated individuals which audibly signals neighbors when a house or building door has not been opened in the previous twenty-four (24) hours and that does not require action on the individuals part.

To achieve the above objectives, it is an object of the present invention to provide an automatic alerting system for incapacitated individuals comprising an audible alerting device located on an exterior surface of a dwelling, a visual alerting device located on the exterior surface of the dwelling, a base unit located on an interior surface of the dwelling, a power cable electrically connected to a power outlet that provides electrical power to the base unit, at least one (1) door sensor located on an exterior door of the dwelling, at least one (1) pressure sensor pad located at a fixed floor location of the dwelling, and at least one (1) motion sensor located in a central location of the dwelling.

A further object of the present invention is having the automatic alerting system further comprise a charge controller located inside the base unit that is powered by electrical power from the power outlet through the power cable.

Another object of the present invention is having the automatic alerting system further comprise a rechargeable battery located inside the base unit that is powered by electrical power routed through the charge controller, wherein the rechargeable battery ensures that adequate power is available for the automatic alerting system in the event of a power failure.

Another object of the present invention is having the automatic alerting system further comprise a timing relay located inside the base unit that is powered by electrical power routed through the charge controller by a first path and a second path, the first path is direct and provides power for operation of the timing relay and provides power for any other components of the automatic alerting system, the second path first travels through a vacation interrupt switch and allows the vacation interrupt switch to be turned off when not needed.

Another object of the present invention is having the automatic alerting system further comprise the door sensor, the pressure sensor pad, and the motion sensor electrically connected in a series thereby activation of only one of the sensors is required for a timing cycle on said timing relay to be reset thus ensuring the audible alerting device and the visual alerting device will not be activated, and the audible alerting device and the visual alerting device are operated by an output of the timing relay whereby the audible alerting device and the visual alerting device are activated by the timing relay if any of the sensors are not activated in a twenty-four (24) hour period.

Another object of the present invention is having the automatic alerting system further comprise an auxiliary relay which is used to generate a dry contact to signal other systems such as a central alarm system, a paging system, an automatic dialer system, or similar system.

Yet another object of the present invention is having the vacation interrupt switch a single-pole, single-throw switch which serves to mimic operation of the door sensor, the pressure sensor pad, and the motion sensor by stimulation continuous action thereby eliminating any possibility of any activation of the automatic alerting system.

Still yet another object of the present invention is having the automatic alerting system electrically connected by a plurality of low voltage wires commonly used in alarm systems, doorbells, or similar items.

Yet still another object of the present invention is having the automatic alerting system electrically connected by a wireless radio frequency signal.

Still another object of the present invention is having the automatic alerting system further comprise the at least one (1) door sensor located on the exterior door of the dwelling that is accessed by a user at least one (1) time per day, at least one (1) pressure sensor pad located at the fixed floor location of the dwelling that is likely to see foot traffic by the user at least one (1) time per day, at least one (1) motion sensor located in a central location of the dwelling likely to see motion of the user at least (1) time per day, wherein the door sensor, the pressure sensor pad, and the motion sensor are individually positioned in the dwelling to determine movement and motion of the user living in the dwelling at least one (1) time during a twenty-four (24) hour period.

Still yet another object of the present invention is having the motion sensor an infrared detector.

Yet another object of the present invention is having the motion sensor an ultrasonic detector.

Still yet another object of the present invention is having the base unit mounted on a table in the dwelling.

Still yet another object of the present invention is having the base unit mounted on a wall of the dwelling.

Yet still another object of the present invention is having the automatic alerting system provided for a single family home.

Still another object of the present invention is having the automatic alerting system provided for an apartment, a multi-family home, a mobile home, a travel trailer, a condominium, or a similar dwelling.

Still yet another object of the present invention is having the automatic alerting system further comprise at least one (1) power indication light.

Yet another object of the present invention is having the automatic alerting system further comprise at least one (1) status light.

Still another object of the present invention is having the automatic alerting system further comprise at least one (1) pre-alarm indicator.

Yet another object of the present invention is having the automatic alerting system further comprise a direction connection to a cellular or other wireless network.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
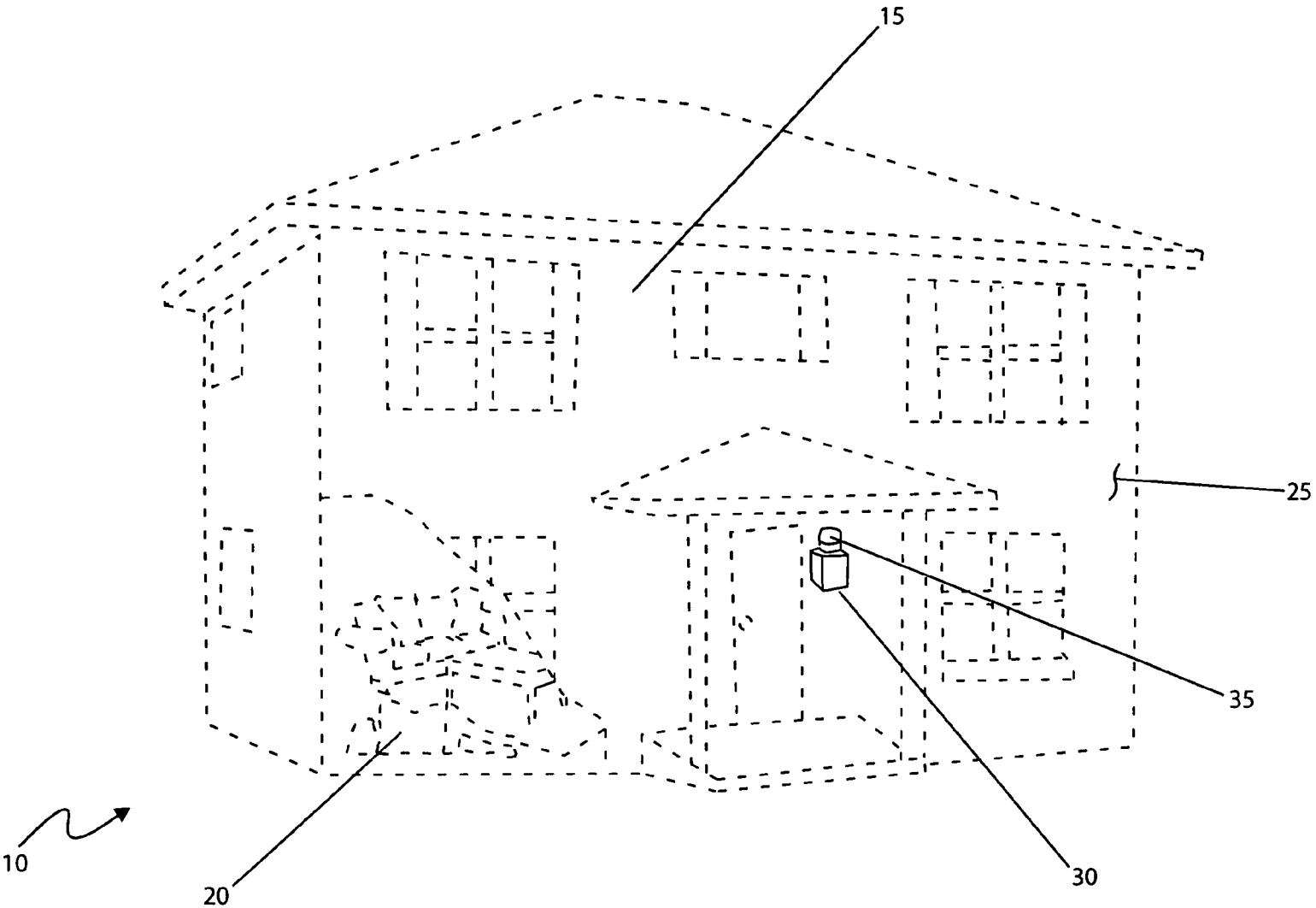
FIG. 1 is a pictorial representation of the automatic alerting system for incapacitated individuals 10 provided on a dwelling 15, according to the preferred embodiment of the present invention.

10 automatic alerting system for incapacitated individuals
15 dwelling
20 incapacitated individual
25 exterior surface
30 audible alerting device
35 visual alerting device
40 base unit
45 power cable
50 conventional power outlet
55 door sensor
60 exterior door
65 pressure sensor pad
70 fixed floor location
75 motion sensor
80 central location
85 charge controller
90 rechargeable battery
95 timing relay
100 vacation interrupt switch
105 auxiliary relay

DETAILED DESCRIPTION OF THE PREFERRED EMBODIMENT

Figure 2:
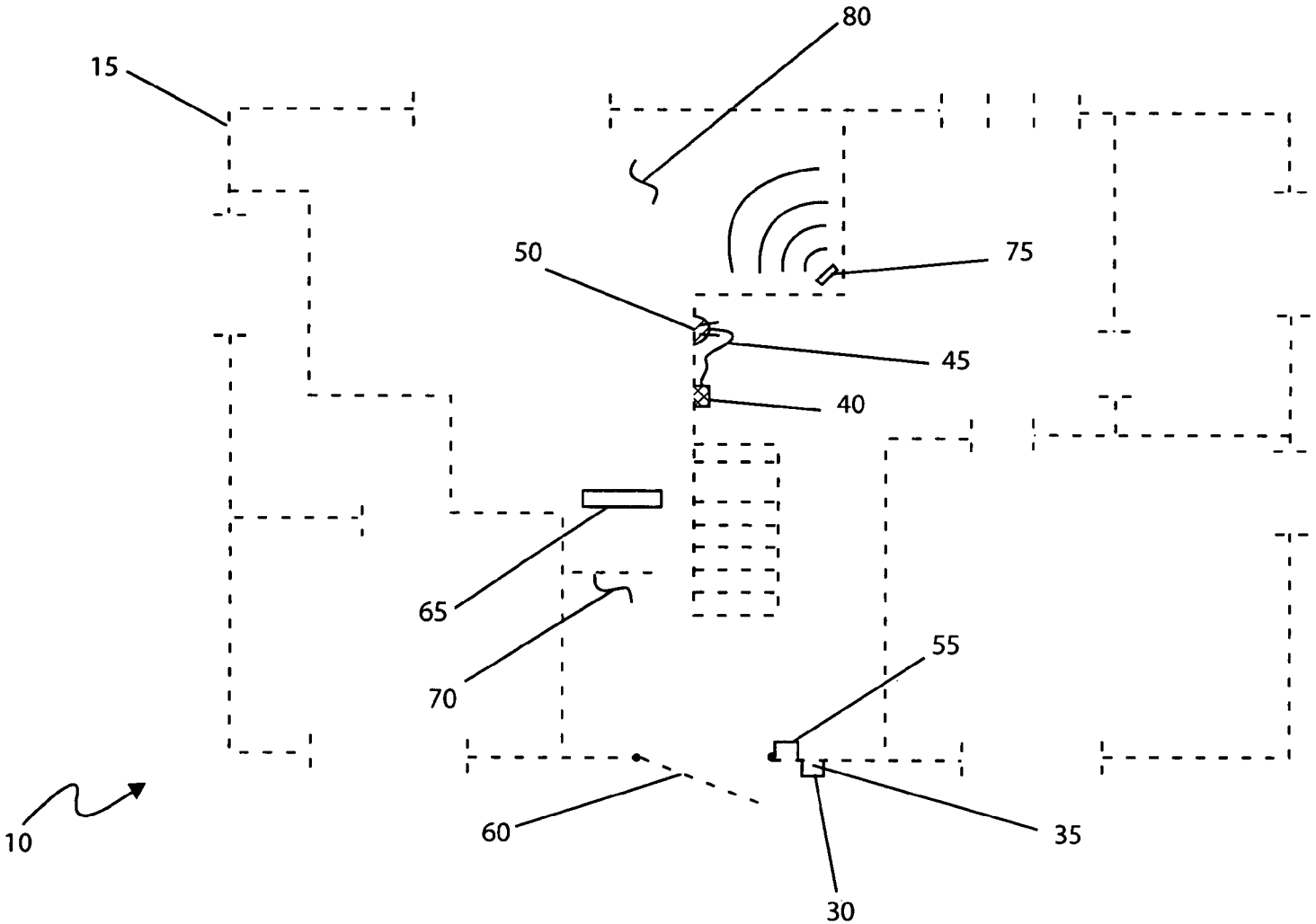
FIG. 2 is a floor plan of a dwelling 15 depicting the location of the major components of the automatic alerting system for incapacitated individuals 10; and, FIG. 3 is an electrical schematic diagram depicting the major electrical components as used in the automatic alerting system for incapacitated individuals 10.
Figure 3:
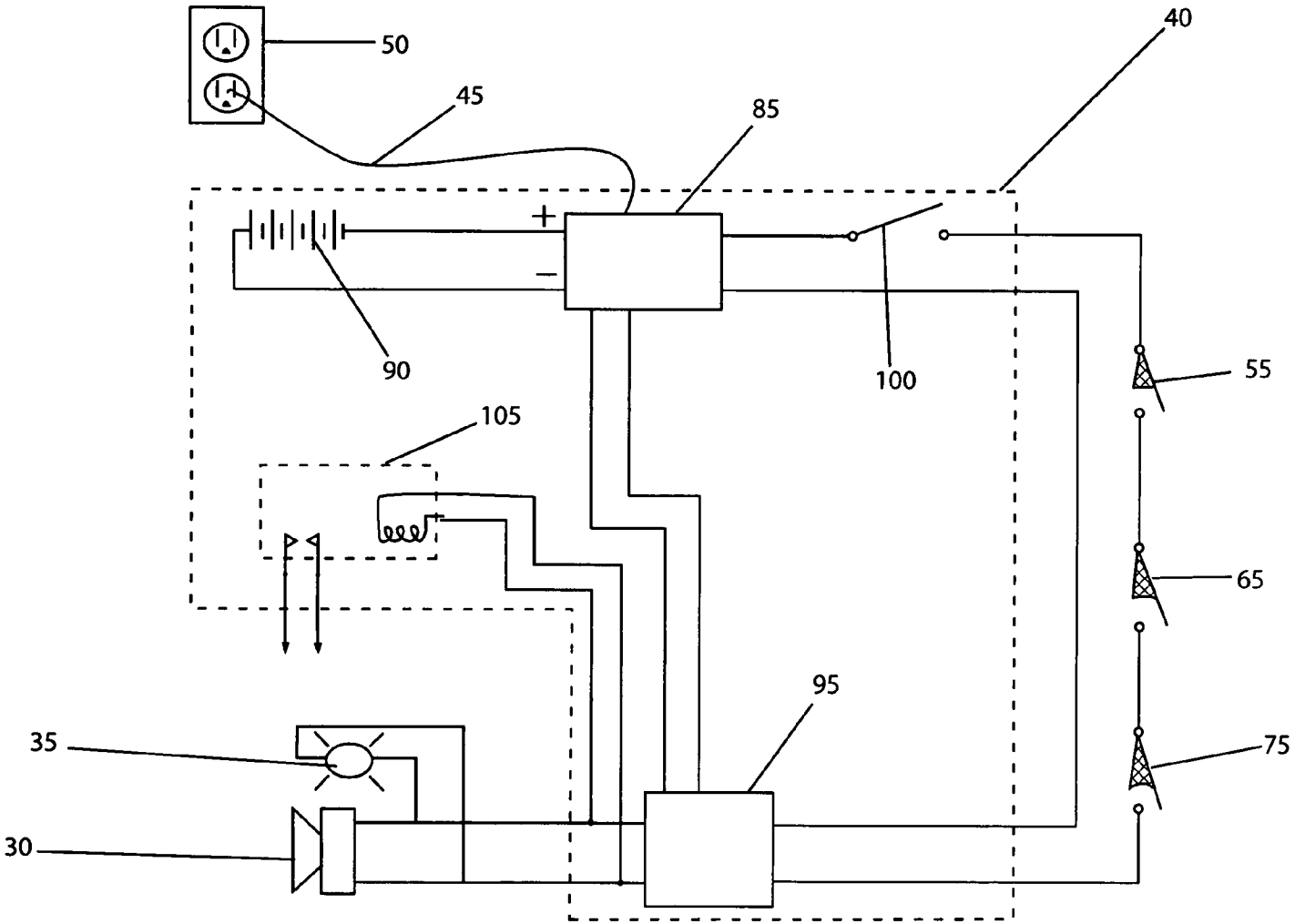

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIG. 1, a pictorial representation of the automatic alerting system for incapacitated individuals 10 provided on a dwelling 15, according to the preferred embodiment of the present invention is disclosed. The dwelling 15 is depicted as a conventional single family home for the purposes of illustration. It should be noted that the automatic alerting system for incapacitated individuals 10 will work in any type of dwelling 15 such as an apartment, a multi-family home, a mobile home, a travel trailer, a condominium, and the like, and as such, said representation of a single family home should not be interpreted as a limiting factor of the present invention. An incapacitated individual 20 is shown lying on the floor of the dwelling 15 (as shown by use of cutaway lines). Said incapacitated individual 20 is viewed as being incapacitated for medical reasons and/or physical reasons such as falling, broken bones or the like. Whatever the reason, the incapacitated individual 20 would be incapable of moving on their own and would thus remain in one location within the dwelling 15. As such, normal activity such as walking around the house, opening the door, checking the mail, walking pets and the like would not occur. Located on an exterior surface 25 of the dwelling 15 are an audible alerting device 30 and a visual alerting device 35. Said audible alerting device 30 and visual alerting device 35 are intended to alert neighbors, passer-bys, motorists, delivery personnel, mail persons, and others who are in the vicinity of the dwelling 15 that a possible emergency situation exists on the inside of the dwelling 15. Said alerting process will be described in greater detail herein below.

Referring next to FIG. 2, a floor plan of a dwelling 15 depicting the location of the major components of the automatic alerting system for incapacitated individuals 10 is depicted. Said floor plan is typical of a common dwelling 15 (as is shown in FIG. 1) and is intended to depict the various components and sensors associated with the automatic alerting system for incapacitated individuals 10 and not necessarily the required layout. In fact, familiarity with the floor plan and the various daily routines typically performed by the occupant of the dwelling 15 is a requirement to ensure for correct operation. As such, repositioning of the required components to suit individual installations is necessary. The audible alerting device 30 and the visual alerting device 35 are located on the exterior of the dwelling 15 as aforementioned described. A base unit 40 is conveniently located on the interior of the dwelling 15 and can either be table mounted or wall mounted. Further description of the interior electrical components inside of the base unit 40 along with its exterior power and control connections will be described in greater detail herein below. Electrical power for the base unit 40 is provided by power cable 45 connected to a conventional power outlet 50. Also seen in FIG. 2, is a variety of actuation sensors. A door sensor 55 is located on an exterior door 60 commonly viewed as being accessed at least on a daily basis for mail retrieval. A pressure sensor pad 65 is located is located at a fixed floor location 70 such as a central hallway or other location likely to see foot traffic by the sole occupant of the dwelling 15 at least multiple times in a day. Finally, a motion sensor 75 is located in a central location 80 such as a kitchen area likely to see motion on at least several times a day. The motion sensor 75 could be of a passive design such as an infrared detector, or of an active design such as an ultrasonic detector. It should be noted that the purpose of the door sensor 55, the pressure sensor pad 65 and the motion sensor 75 is to determine movement and motion of the single occupant of the dwelling 15 at least once during a 24 hour time period. As such, the quantity and location of the door sensor 55, the pressure sensor pad 65, and the motion sensor 75 must be analyzed on an individual basis with the minimum quantity being at least one of any of the selected sensors and the maximum being several of each. Additionally careful consideration as to the type and placement of the sensors must be considered for dwelling 15 in which there are pets, such as dogs and cats, present that could inadvertently prevent the automatic alerting system for incapacitated individuals 10 from operating by activating certain types of sensors or sensors in a certain location. It should also be noted that the operation of the door sensor 55, the pressure sensor pad 65, and the motion sensor 75 will occur in a passive manner, that is, no specific action, other than ordinary everyday activity or actions is necessary to activate the automatic alerting system for incapacitated individuals 10. Said activities include opening a door, walking down a hallway or preparing a meal in the kitchen. It is envisioned that the wiring between the various items would be of the low voltage variety commonly used in alarm systems, doorbells, and the like. Other intercommunication schemes such as wireless radio frequency can also be used with equal effectiveness and as such, should not be interpreted as a limiting factor of the present invention.

Referring finally to FIG. 3, an electrical schematic diagram depicting the major electrical components as used in the automatic alerting system for incapacitated individuals 10 is disclosed. In addition, this FIG. more clearly identifies the operating sequence of the automatic alerting system for incapacitated individuals 10 as well. Power for the automatic alerting system for incapacitated individuals 10 is derived from the conventional power outlet 50 via the power cable 45 and delivered to a charge controller 85 inside of the base unit 40. Power from the charge controller 85 is routed to a rechargeable battery 90 located inside of the base unit 40. In such a manner the rechargeable battery 90 "floats" across the power supply for the balance of the circuit components ensuring that adequate power is always available for the automatic alerting system for incapacitated individuals 10 even in the event of a power failure. It is envisioned that the rechargeable battery 90 has adequate power capacity for at least 3 days of operation. Power from the charge controller 85 is routed to a timing relay 95 along dual paths. The first path is direct and provides power for operation of the relay as well as any downstream devices which may require power. The second path first travels through a vacation interrupt switch 100 which basically allows the vacation interrupt switch 100 to be turned off when not needed. Such times are envisioned as when the occupant is not in the dwelling 15 (as shown in FIG. 1) for extended periods of time such as vacations, overnight visits, long term hospitals stays, and the like. The vacation interrupt switch 100 is a single-pole, single-throw switch which serves to mimic the operation of the door sensor 55, the pressure sensor pad 65 and the motion sensor 75 by simulating continuous action and thus eliminating the possibility of any activation of the automatic alerting system for incapacitated individuals 10 regardless of other activity in the dwelling 15 (as shown in FIG. 1). In its normal or armed position, it is closed. Next in line in a series connected fashion is one door sensor 55, followed by one pressure sensor pad 65 and followed by one motion sensor 75. All such devices are normally closed in their inactivated position and only open when action or motion is detected. It should be noted that all sensors are wired in series, such that only one of the sensors is required for activation. Said activation results in the resetting of the timing cycle on the timing relay 95 upon re-closing of the associated sensor. Such a feature means that the timing relay 95 will never operate as long as at least one of the door sensor 55, the pressure sensor pad 65 or the motion sensor 75 activate and recluse in a 24 hour period. The output of the timing relay 95 is used to operate the audible alerting device 30, the visual alerting device 35 and an auxiliary relay 105 which is used to generate a dry contact to signal other system such as a central alarm system, a paging system, an automatic dialer system, or the like. Such interfaces thus provide remote indication for a possible incapacitated individual 20 (as shown in FIG. 1) at dwelling 15 (as shown in FIG. 1) that are not readily accessed by others such as homes set far back from the road, homes blocked by trees, or homes in remote locations such as cabins. Such circuitry as shown in FIG. 3 is intended to represent the minimum required for desired operation. As such, other auxiliary circuits such as power indication lights, status lights, pre-alarm indication (such as after twenty-three and a half (23½) hours), direct connection to a cellular or other wireless networks or the like are also envisioned. As such, the exclusion of such peripheral items are not intended to be a limiting factor of the present invention.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. It is envisioned that the automatic alerting system for incapacitated individuals 10 would be manufactured and installed in general accordance with FIG. 1, FIG. 2, and FIG. 3. Careful attention to the exact placement of any door sensor 55, and pressure sensor pad 65 and any motion sensor 75 would be necessary to ensure that at least of the sensors would be activated by the occupant during the course of a day at least once and preferably multiple times. Interconnecting wiring would be hidden behind walls, under carpet or by other practices suitable for use and acknowledged in the art. After suitable testing to ensure operation, the system is ready for operation.

During the course of a 24 day, the occupant of the dwelling 15 would go about his or her daily business, such as walking about the house, gathering mail, performing house chores, preparing mail, and the like. Every time such action triggers either a door sensor 55, a pressure sensor pad 65 or a motion sensor 75, the automatic alerting system for incapacitated individuals 10 resets the internal timing relay 95 thus beginning another 24 hour count down cycle. Should the services of the automatic alerting system for incapacitated individuals 10 not be desired, the vacation interrupt switch 100 is placed in the unarmed position. However, should the occupant become an incapacitated individual 20 and become unable to move or access a telephone for help, no further sensors would be activated. After the completed time period, which would now be only a maximum of 24 hours, the timing relay 95 would close and signal for help by use of the audible alerting device 30, the visual alerting device 35 or remote signaling systems as identified above by use of the auxiliary relay 105. After help arrives and the situation corrected, a simple activation of any of the sensors depicted by the door sensor 55, the pressure sensor pad 65 or the motion sensor 75 will restore the automatic alerting system for incapacitated individuals 10 to its armed state and thus recycling it for future operation and safety of the occupant.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An automatic alerting system for incapacitated individuals, comprising:

an audible alerting device located on an exterior surface of a dwelling;

a visual alerting device located on said exterior surface of said dwelling;

a base unit located on an interior surface of said dwelling in electrical communication therewith said audible alerting device and said visual alerting device;

a power cable electrically connecting a power outlet thereto said base unit to provide electrical power to said base unit;

at least one (1) door sensor located on an exterior door of said dwelling in electrical communication therewith said base unit;

at least one (1) pressure sensor pad located at a fixed floor location of said dwelling in electrical communication therewith said base unit;

at least one (1) motion sensor located in a central location of said dwelling in electrical communication therewith said base unit;

a charge controller located inside said base unit powered by electrical power from said power outlet through said power cable;

a rechargeable battery located inside said base unit powered by electrical power routed through said charge controller, wherein said rechargeable battery ensures adequate power is available for said automatic alerting system in the event of a power failure; and, a timing relay located inside said base unit powered by electrical power routed through said charge controller by a first path and a second path;

wherein said first path is direct and provides power for operation of said timing relay and provides power for any other components of said automatic alerting system;

wherein said second path first travels through a vacation interrupt switch and allows said vacation interrupt switch to be turned off when not needed;

wherein said door sensor, said pressure sensor pad, and said motion sensor are electrically connected in a series, wherein activation of only one of either said door sensor, said pressure sensor pad, or said motion sensor is required for a timing cycle on said timing relay to be reset, thus ensuring said audible alerting device and said visual alerting device will not be activated; and, wherein said audible alerting device and said visual alerting device are operated by an output of said timing relay, wherein said audible alerting device and said visual alerting device are activated by said timing relay if any of said door sensor, said pressure sensor pad, or said motion sensor are not activated in a pre-determined time.

2. The automatic alerting system of claim 1, wherein said automatic alerting system further comprises an auxiliary relay which is used to generate a dry contact to signal other systems such as a central alarm system, a paging system, an automatic dialer system, or similar system.

3. The automatic alerting system of claim 1, wherein said vacation interrupt switch is a single-pole, single-throw switch which serves to mimic operation of said door sensor, said pressure sensor pad, and said motion sensor by stimulation continuous action thereby eliminating any possibility of any activation of said automatic alerting system.

4. The automatic alerting system of claim 1, wherein said automatic alerting system is electrically connected by a plurality of low voltage wires.

5. The automatic alerting system of claim 1, wherein said automatic alerting system is electrically connected by a wireless radio frequency signal.

6. The automatic alerting system of claim 1, wherein said automatic alerting system further comprises:

at least one (1) door sensor is located on said exterior door of said dwelling that is accessed by a user at least one (1) time per day;

at least one (1) pressure sensor pad is located at said fixed floor location of said dwelling that is likely to see foot traffic by said user at least one (1) time per day; and, at least one (1) motion sensor is located in a central location of said dwelling likely to see motion of said user at least (1) time per day;

wherein said door sensor, said pressure sensor pad, and said motion sensor are individually positioned in said dwelling to determine movement and motion of said user living in said dwelling at least one (1) time during said pre-determined time.

7. The automatic alerting system of claim 6, wherein said pre-determined time is a twenty-four (24) hour period.

8. The automatic alerting system of claim 1, wherein said motion sensor is an infrared detector.

9. The automatic alerting system of claim 1, wherein said motion sensor is an ultrasonic detector.

10. The automatic alerting system of claim 1, wherein said base unit is mounted on a table in said dwelling.

11. The automatic alerting system of claim 1, wherein said base unit is mounted on a wall of said dwelling.

12. The automatic alerting system of claim 1, wherein said automatic alerting system is provided for a single family home, an apartment, a multi-family home, a mobile home, a travel trailer, a condominium, or a similar dwelling.

13. The automatic alerting system of claim 1, wherein said automatic alerting system further comprises at least one (1) power indication light in electrical communication therewith said base unit.

14. The automatic alerting system of claim 1, wherein said automatic alerting system further comprises at least one (1) status light in electrical communication therewith said base unit.

15. The automatic alerting system of claim 1, wherein said automatic alerting system further comprises at least one (1) pre-alarm indicator in electrical communication therewith said base unit.

16. The automatic alerting system of claim 1, wherein said automatic alerting system further comprises a direction connection to a cellular or other wireless network.

17. An automatic alerting system for incapacitated individuals, comprising:

an audible alerting device located on an exterior surface of a dwelling;

a visual alerting device located on said exterior surface of said dwelling;

a base unit located on an interior surface of said dwelling in electrical communication therewith said audible alerting device and said visual alerting device;

a power cable electrically connecting a power outlet thereto said base unit to provide electrical power to said base unit;

at least one (1) door sensor located on an exterior door of said dwelling in electrical communication therewith said base unit;

at least one (1) pressure sensor pad located at a fixed floor location of said dwelling in electrical communication therewith said base unit;

at least one (1) motion sensor located in a central location of said dwelling in electrical communication therewith said base unit;

a charge controller located inside said base unit that is powered by electrical power from said power outlet through said power cable;

a rechargeable battery located inside said base unit that is powered by electrical power routed through said charge controller, wherein said rechargeable battery ensures adequate power is available for said automatic alerting system in the event of a power failure; and, a timing relay located inside said base unit powered by electrical power routed through said charge controller by a first path and a second path;

wherein said first path is direct and provides power for operation of said timing relay and provides power for any other components of said automatic alerting system;

wherein said second path first travels through a vacation interrupt switch and allows said vacation interrupt switch to be turned off when not needed;

wherein said door sensor, said pressure sensor pad, and said motion sensor are electrically connected in a series, wherein activation of only one of either said door sensor, said pressure sensor pad, or said motion sensor is required for a timing cycle on said timing relay to be reset, thus ensuring said audible alerting device and said visual alerting device will not be activated; and, wherein said audible alerting device and said visual alerting device are operated by an output of said timing relay wherein said audible alerting device and said visual alerting device are activated by said timing relay if any of said door sensor, said pressure sensor pad, or said motion sensor are not activated in a twenty-four (24) hour period.

18. The automatic alerting system of claim 17, wherein said automatic alerting system further comprises an auxiliary relay which is used to generate a dry contact to signal other systems such as a central alarm system, a paging system, an automatic dialer system, or similar system.

19. The automatic alerting system of claim 18, wherein said vacation interrupt switch is a single-pole, single-throw switch which serves to mimic operation of said door sensor, said pressure sensor pad, and said motion sensor by stimulation continuous action thereby eliminating any possibility of any activation of said automatic alerting system.

* * * * *